US007530634B1

(12) United States Patent
Mortazavi et al.

(10) Patent No.: US 7,530,634 B1
(45) Date of Patent: May 12, 2009

(54) HEAD SUPPORT SYSTEM FOR INFANTS AND TODDLERS

(76) Inventors: Rosemarie M. Mortazavi, 15321 SW. 162 St., Miami, FL (US) 33187; Hamid R. Mortazavi, 15321 SW. 162 St., Miami, FL (US) 33187

( * ) Notice: Subject to any disclaimer, the term of this patent is extended or adjusted under 35 U.S.C. 154(b) by 0 days.

(21) Appl. No.: 12/109,864

(22) Filed: Apr. 25, 2008

(51) Int. Cl.
*A47C 31/00* (2006.01)

(52) U.S. Cl. ..... 297/219.12; 297/393; 297/181; 2/171

(58) Field of Classification Search ..... 297/219.12, 297/393, 181, 220; 2/171, 311
See application file for complete search history.

(56) References Cited

U.S. PATENT DOCUMENTS 4,707,031 A 11/1987 Meistrell
6,386,639 B1 * 5/2002 McMichael ..... 297/393 X
6,799,802 B1 10/2004 Moran
2005/0268377 A1 12/2005 Massey
2006/0082205 A1 4/2006 Hobson
2006/0108850 A1 5/2006 Miller

* cited by examiner

*Primary Examiner*—Anthony D Barfield
(74) *Attorney, Agent, or Firm*—Albert Bordas, P.A.

(57) ABSTRACT

A head support system, comprising a seat cover having a front portion and a rear portion that terminate at a bottom end. The front portion comprises first and second loop padding. Headwear comprises first and second earpieces. The first and second earpieces have third and fourth loop padding thereon. Double-sided hook padding attaches onto the first and second loop padding, and the third and fourth loop padding respectively. Restraining means are used to restrain an infant or toddler's head in an upright position with comfort to the infant or toddler.

9 Claims, 3 Drawing Sheets

HEAD SUPPORT SYSTEM FOR INFANTS AND TODDLERS

BACKGROUND OF THE INVENTION

1. Field of the Invention

The present invention relates to support systems, and more particularly, to a head support system that is mounted to a seat assembly.

2. Description of the Related Art

Often times, especially when traveling in an automobile, the head of an infant or toddler often sways while the infant or toddler is asleep in a seat assembly such as a car seat. In some cases, such swaying can cause discomfort to the infant or toddler.

Applicant believes that one of the closest references corresponds to U.S. Patent Application Publication No. 2006/0082205, published on Apr. 20, 2006 to Hobson for Sleeping Aid. However, it differs from the present invention because Hobson teaches a hat with a hook and loop type fastener that directly attaches to a second piece of hook and loop type fastener that is situated on the flat back area of a car seat, child carrier device, wheel chair or any other restraint device used to transport infants or toddlers, larger children or physically challenged individuals.

Applicant believes that another reference corresponds to U.S. Patent Application Publication No. 2006/0108850, published on May 25, 2006 to Miller for Device and Method for Head Restraint. However, it differs from the present invention because Miller teaches a device capable of supporting a user's head when the user is seated in an upright position having a head support device with a support apparatus capable of fitting between a user's back and a seat surface and a securing apparatus capable of holding the user's head, wherein the support apparatus provides a rigid or semi-rigid support when fitted between the user and the seat surface and the securing apparatus is capable of securing the user's head to the support apparatus.

Applicant believes that another reference corresponds to U.S. Patent Application Publication No. 2005/0268377, published on Dec. 8, 2005 to Massey for Head Restraint Device. However, it differs from the present invention because Massey teaches a head restraint system for supporting the head of a person wearing headwear while seated. Massey's head restraint is comprised of a headwear portion and a rear-mounting portion. The headwear portion is comprised of an article of headwear with one part of a fastener attached at the rear of the headwear. The rear-mounting portion comprises the other part of said fastener attached to the rear mount such that a user wearing the headwear may lean his or her head against the seat thereby engaging the parts of the fastener and in turn restraining the users head. In some embodiments, the rear mount is the back of a seat, and in other embodiments, a separate rear-mounting fixture is provided.

Applicant believes that another reference corresponds to U.S. Pat. No. 6,799,802 issued to Moran on Oct. 5, 2004 for Head Support Device. However, it differs from the present invention because Moran teaches a head support device for supporting the head of a person in an upright position against the back support of a chair. The head support device includes a flexible panel having a first side and a second side. The panel has a first edge, a second edge, a third edge, and a fourth edge wherein the first and second edges are positioned opposite of each other. The third and fourth edges extend outward in opposite directions at junctures with the first and second edges such that four flaps are defined. A fastening means removably fastens two flaps on the third edge together and the two flaps on the fourth edge together. A securing means removably secures the first side of the panel to the chair.

Applicant believes that another reference corresponds to U.S. Pat. No. 4,707,031 issued to Meistrell on Nov. 17, 1987 for Head Restraint. However, it differs from the present invention because Meistrell teaches a head support for a traveler sitting in a chair having a headrest, and which includes a first band adapted to be fitted in adjustably wrapped condition closely about the user's head and at eye or forehead level, a band retention structure associated with the band for retaining the band in said wrapped condition, and a head restraint structure coupled to the band and adapted to be coupled to the headrest for restraining the user's head against lateral side-to-side movement relative to the headrest.

Other patents describing the closest subject matter provide for a number of more or less complicated features that fail to solve the problem in an efficient and economical way. None of these patents suggest the novel features of the present invention.

SUMMARY OF THE INVENTION

The instant invention is a head support system that comprises a seat cover having a front portion with a first bottom end, and a rear portion having a second bottom end. The front portion comprises first and second loop padding. In the preferred embodiment, the second bottom end has an elastic member secured thereon. The front portion further comprises first elongated holes. A seam is defined between the front portion and the rear portion, and it comprises second elongated holes. The seam further comprises at least one slit.

Headwear comprises first and second earpieces. The first and second earpieces have third and fourth loop padding thereon. Double-sided hook padding attaches onto the first and second loop padding and the third and fourth loop padding respectively. In the preferred embodiment, the first and second earpieces extend from sides of the headwear.

Restraining means restrain an infant or toddler's head in an upright position. The restraining means comprises sliding the seat cover onto a backrest of a seat assembly and aligning and attaching the double-sided hook padding onto the first and second loop padding; then placing the headwear onto the head of the infant, and aligning and attaching the third and fourth loop padding onto the double-sided hook padding.

The seat assembly comprises a seat that has a backrest and at least one seatbelt. The at least one seatbelt passes through the first elongated holes.

It is therefore one of the main objects of the present invention to provide a head support system for infants that restrains the head of an infant or toddler sitting in a seat assembly with comfort to the infant or toddler.

It is another object of this invention to provide a head support system for infants that prevents the head of an infant or toddler from swaying while sitting in a seat assembly.

It is another object of this invention to provide a head support system for infants that prevents the head of an infant or toddler from swaying while sleeping in a seat assembly.

It is another object of this invention to provide a head support system for infants that prevents neck discomfort to the infant or toddler.

It is yet another object of this invention to provide a head support system for infants that restrains the head of an infant or toddler sitting in a seat assembly in an upright position with comfort to the infant or toddler.

It is yet another object of this invention to provide a head support system for infants that is easy to install and maintain.

It is yet another object of this invention to provide a head support system for infants that is volumetrically efficient for transportation and storage.

It is still another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
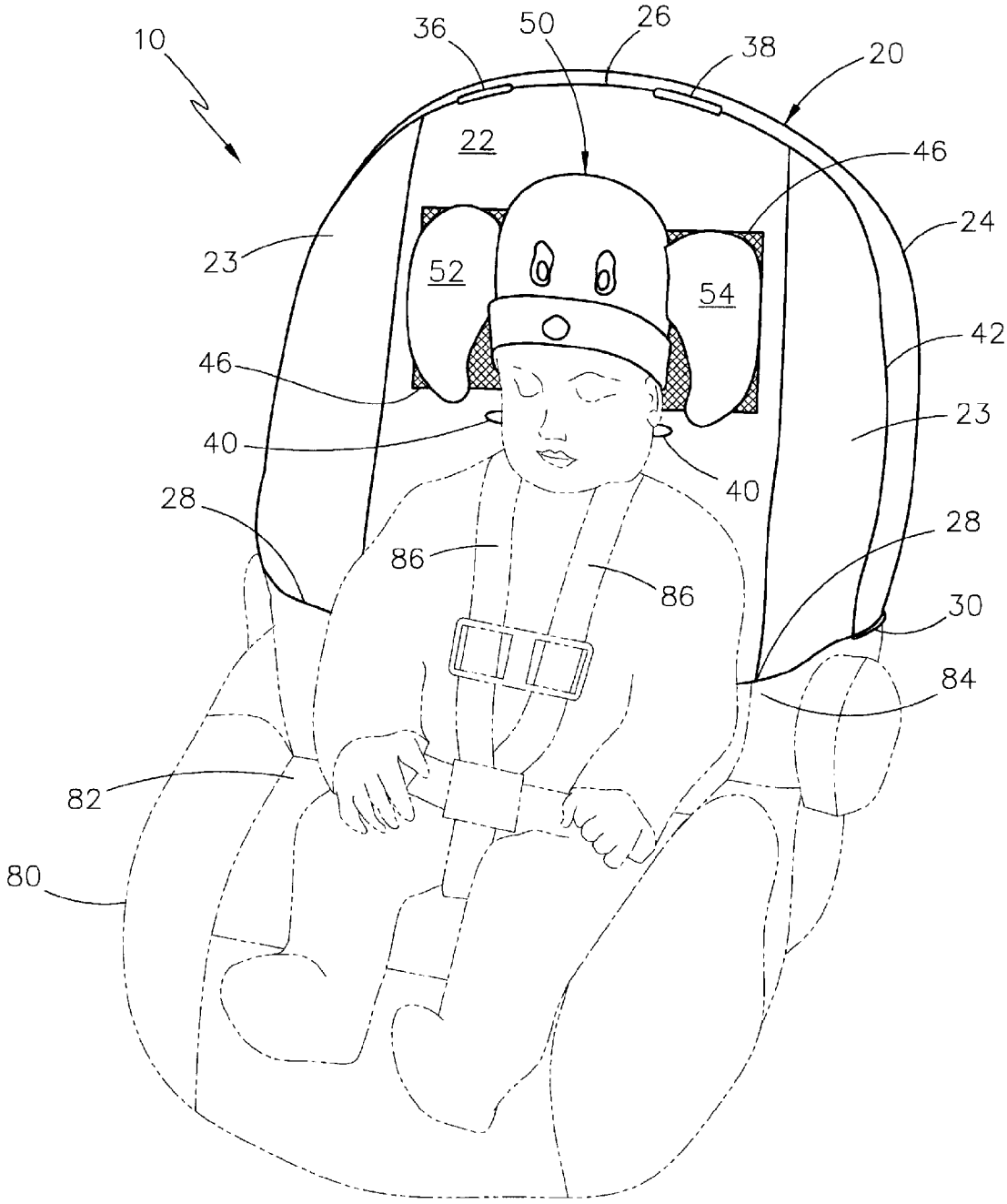
FIG. 1 represents an isometric view of the instant invention as used by an infant sleeping in a seat assembly.

Referring now to the drawings, the head support system for infants and toddlers is generally referred to with numeral 10. It can be observed that it basically includes seat cover 20 and headwear 50.

As seen in FIG. 1, seat cover 20 is mounted onto seat assembly 80. In the preferred embodiment, seat assembly 80 comprises seat 82 having backrest 84 and seatbelts 86, and is a car seat or a booster seat for use in an automobile. However, seat cover 20 may also be mounted onto a stroller, such as an umbrella stroller; an infant carrier; a toddler carrier; or similar seating/resting device in which an infant sits in.

Figure 2B:
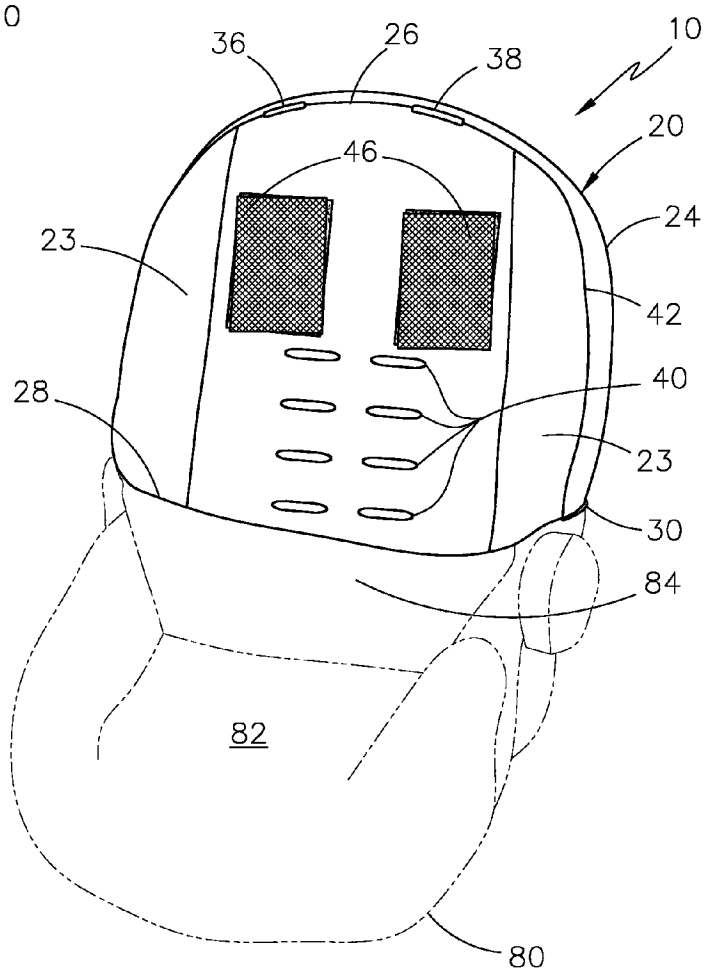
FIG. 2B is an isometric view of the seat cover of the instant invention, with the double-sided hook padding thereon.
Figure 2A:
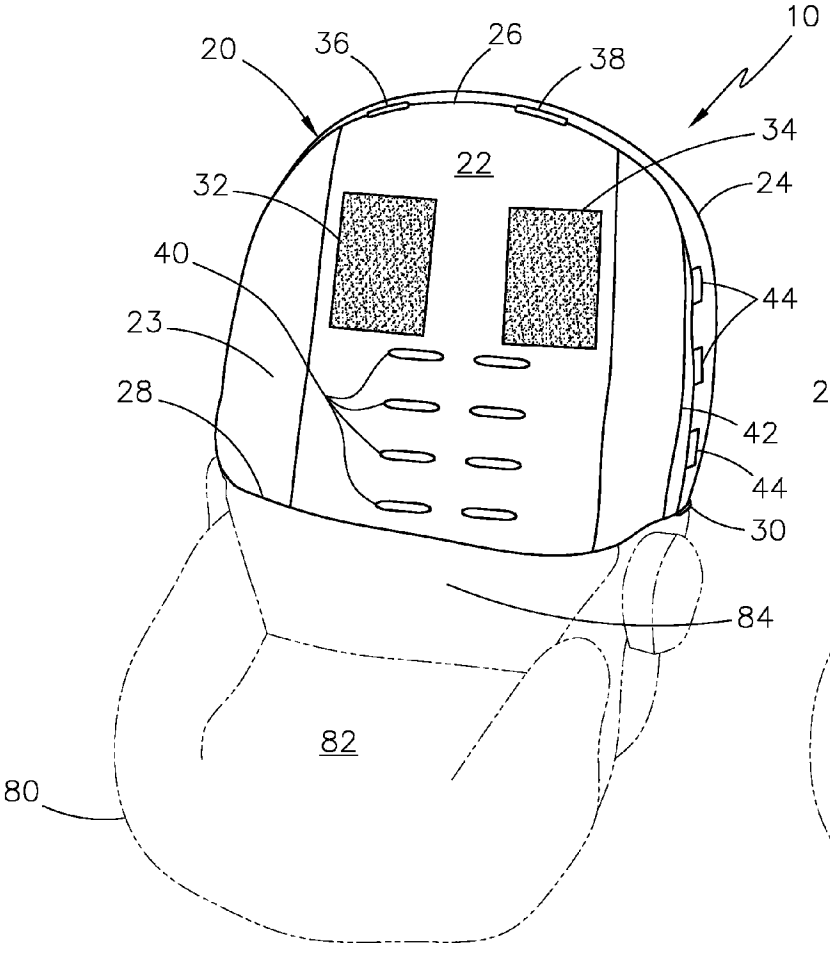
FIG. 2A is an isometric view of a seat cover of the instant invention, without double-sided hook padding thereon.

As seen in FIGS. 2A and 2B, seat cover 20 primarily comprises front portion 22, side portions 23, and rear portion 24 that terminate at bottom end 28. In the preferred embodiment, side portions 23 are sufficiently padded to form an ergonomic design, thus allowing an infant to comfortably rest his/her back against front portion 22 while having support from side portions 23. Bottom end 28 of rear portion 24 has elastic member 30 secured thereon. In the preferred embodiment, elastic member 30 is an elastic band or rubber band. Front portion 22 comprises loop padding 32 and 34, and elongated holes 40. Seam 26 comprises elongated holes 36 and 38, and slits 42. Slits 42 comprise loop-padding 44 as seen in FIG. 2A. It is noted that although only one side is visible in FIGS. 1; 2A; and 2B, slits 42 exist on each side of seam 26. In addition, although not illustrated, an underside face of slits 42 comprise hook padding that aligns with and adheres onto its corresponding loop padding 44, to close slits 42 as illustrated in FIG. 2B.

Any pair of elongated holes 40, depending on the size of the infant, may be used to allow seatbelts 86, seen in FIG. 1, to pass therethrough, thereby allowing the infant to be strapped in and secured within seat assembly 80, as seen in FIG. 1. While in use on a stroller, such as an umbrella stroller, elongated holes 36 and 38 are cooperatively disposed to receive stroller handles when seat cover 20 is mounted onto the umbrella stroller. Elastic member 30 keeps seat cover 20, and specifically bottom end 28, snuggly fitted onto backrest 84.

In the event that seat assembly 80 has lateral seat belts, buckles, loops, or additional restraining devices, not seen, slits 42 allow them to protrude therethrough to further restrain the infant. This is especially the case when the infant outgrows the use of seatbelts 86 and needs to be restrained by the additional lateral seat belts, buckles, loops, or additional restraining devices. In addition, vehicle seat belts, not illustrated, may also protrude through slits 42 to further restrain the infant.

Figure 3A:
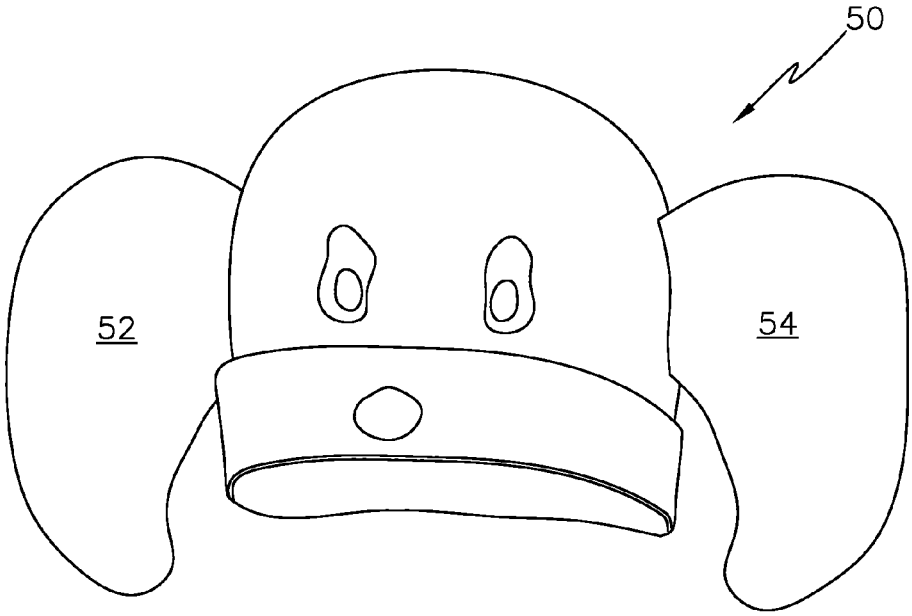
FIG. 3A is an isometric front view of a headwear of the instant invention.
Figure 3B:
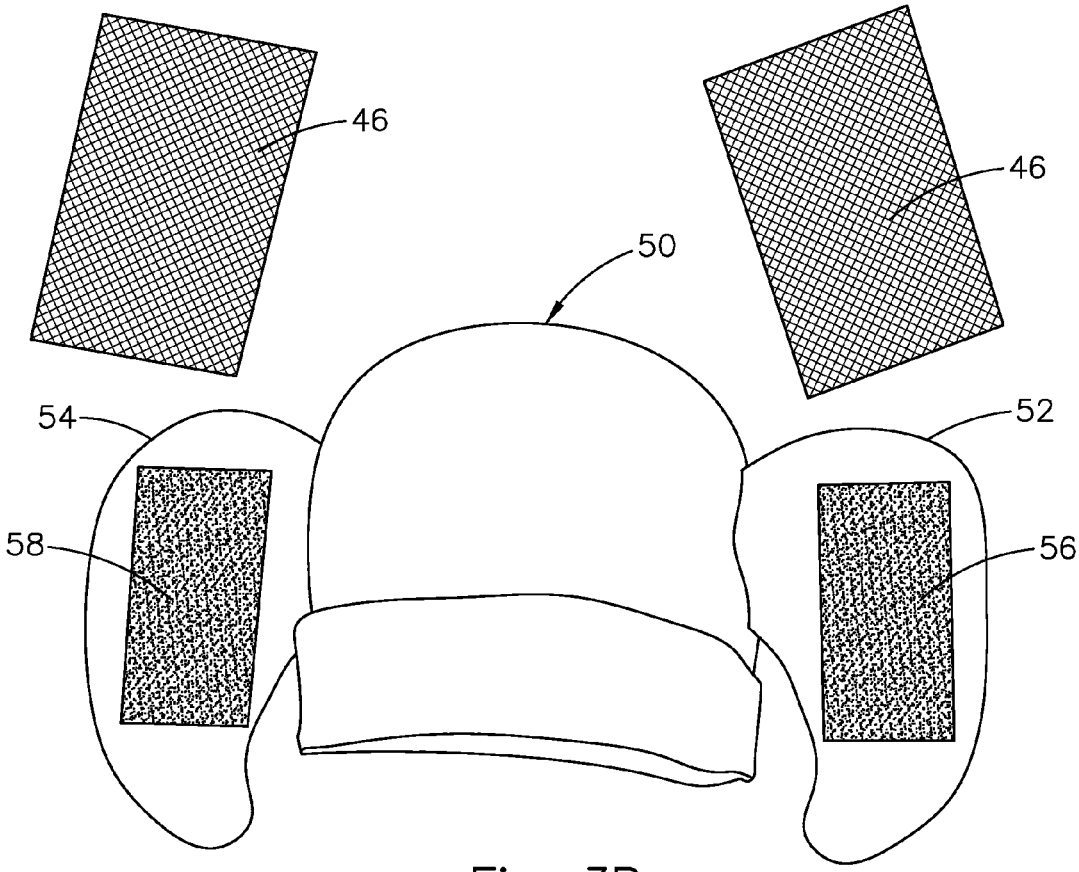
FIG. 3B is an isometric rear view of the headwear of the instant invention, and the double-sided hook padding.

As seen in FIGS. 3A and 3B, headwear 50 comprises earpieces 52 and 54. In the preferred embodiment, earpieces 52 and 54 extend from the sides of headwear 50. It is noted that headwear 50 may resemble or represent animals, cartoon characters, or other designs attractive to infants and toddlers in general. Earpieces 52 and 54 have loop padding 56 and 58 respectively, fixed onto a rear side thereon, as best seen in FIG. 3B. Double-sided hook padding 46 are independent pieces that have a cooperative dimension and shape to align with and attach onto loop padding 32 and 34, and loop padding 56 and 58, respectively.

In operation and defining restraining means, as best seen in FIG. 1, seat cover 20 is slid over and onto backrest 84 so that elastic member 30 keeps seat cover 20, and specifically bottom end 28, snuggly fitted onto backrest 84. Double-sided hook padding 46 are aligned with and attached onto loop padding 32 and 34. Any pair of elongated holes 40, depending on the size of the infant, may be used to allow seatbelts 86, to pass therethrough. In addition, in the event that seat assembly 80 has lateral seat belts, buckles, loops, or additional restraining devices, not seen, slits 42 allow them to protrude therethrough to further restrain the infant. The infant or toddler is seated within seat assembly 80 and restrained by seatbelts 86 and all other lateral seat belts, buckles, loops, or additional restraining devices. Headwear 50 is placed onto his/her head as seen in this illustration. Loop padding 56 and 58 is aligned with and attached onto double-sided hook padding 46, thus restraining the head of the infant while sitting in seat assembly 80 with comfort to the infant or toddler. Instant invention 10 prevents the head of an infant or toddler from swaying while sitting or sleeping in seat assembly 80 to prevent neck discomfort to the infant or toddler and restrains the head of the infant or toddler an upright position with comfort to the infant or toddler.

In the preferred embodiment, loop padding 32, 34, 44, 56, and 58, and double-sided hook padding 46, may be "VELCRO".

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A head support system, comprising:

A) a seat cover having a front portion comprising a first bottom end, and a rear portion comprising a second bottom end, said second bottom end has an elastic member secured thereon, said front portion comprises first and second loop padding;

B) headwear comprising first and second earpieces, said first and second earpieces having third and fourth loop padding thereon, said first and second earpieces extend from sides of said headwear;

C) double-sided hook padding that attaches onto said first and second loop padding, and said third and fourth loop padding respectively; and D) restraining means to restrain an infant or toddler's head in an upright position while in a seat assembly.

2. The head support system set forth in claim 1, further characterized in that said seat assembly comprises a seat having a backrest and at least one seatbelt.

3. The head support system set forth in claim 2, further characterized in that said front portion further comprises first elongated holes.

4. The head support system set forth in claim 3, further characterized in that a seam defined between said front portion and said rear portion, said seam comprises second elongated holes.

5. The head support system set forth in claim 4, further characterized in that said seam further comprises at least one slit.

6. The head support system set forth in claim 5, further characterized in that said at least one seatbelt passes through said first elongated holes.

7. A head support system, comprising:

A) a seat cover having a front portion comprising a first bottom end, a rear portion comprising a second bottom end, and first and second side portions, said second bottom end has an elastic member secured thereon, said first and second side portions comprising padding, said front portion comprises first and second loop padding;

B) headwear comprising first and second earpieces, said first and second earpieces having third and fourth loop padding thereon, said first and second earpieces extend from sides of said headwear;

C) double-sided hook padding that attaches onto said first and second loop padding, and said third and fourth loop padding respectively; and D) restraining means to restrain an infant or toddler's head in an upright position, said restraining means comprises sliding said seat cover onto a backrest of a seat assembly, aligning and attaching said double-sided hook padding onto said first and second loop padding, placing said headwear onto said head, and aligning and attaching said third and fourth loop padding onto said double-sided hook padding.

8. The head support system set forth in claim 7, further characterized in that said seat assembly comprises a seat having a backrest and at least one seatbelt.

9. The head support system set forth in claim 8, further characterized in that said front portion further comprises first elongated holes, and further characterized in that a seam defined between said front portion and said rear portion, said seam comprises second elongated holes, said seam further comprises at least one slit, and said at least one seatbelt passes through said first elongated holes.

* * * * *